US005875747A

United States Patent [19]

Lamp

[11] Patent Number: 5,875,747

[45] Date of Patent: Mar. 2, 1999

[54] INTERNAL COMBUSTION ENGINE

[76] Inventor: Justin Lamp, 240B-B New Dr., Winston-Salem, N.C. 27103

[21] Appl. No.: 80,731

[22] Filed: May 18, 1998

Related U.S. Application Data

[63] Continuation-in-part of Ser. No. 824,471, Mar. 26, 1997.

[51] Int. Cl.[6] ..... F01L 9/04

[52] U.S. Cl. ..... 123/90.11; 251/129.01; 123/188.4

[58] Field of Search ..... 123/90.11, 90.15, 123/188.1, 188.4; 251/129.01

[56] References Cited

U.S. PATENT DOCUMENTS

| | | | |
|---|---|---|---|
| 4,482,094 | 11/1984 | Knape . | |
| 4,520,962 | 6/1985 | Momono et al. . | |
| 4,875,658 | 10/1989 | Asai . | |
| 4,941,612 | 7/1990 | Li . | |
| 4,951,874 | 8/1990 | Ohnishi et al. . | |
| 4,984,549 | 1/1991 | Mesenich . | |
| 5,012,982 | 5/1991 | Souma et al. . | |
| 5,016,583 | 5/1991 | Blish | 123/90.11 |
| 5,022,353 | 6/1991 | Kawamura | 123/90.11 |
| 5,109,824 | 5/1992 | Okamoto et al. . | |
| 5,111,779 | 5/1992 | Kawamura | 123/90.11 |
| 5,125,370 | 6/1992 | Kawamura | 123/90.11 |
| 5,127,585 | 7/1992 | Mesenich . | |
| 5,129,369 | 7/1992 | Kawamura | 123/90.11 |
| 5,193,492 | 3/1993 | Kawamura | 123/90.11 |
| 5,255,845 | 10/1993 | Brunel . | |
| 5,417,373 | 5/1995 | Facchin . | |
| 5,443,209 | 8/1995 | VanAllsburg . | |
| 5,517,951 | 5/1996 | Paul et al. | 123/90.11 |
| 5,518,185 | 5/1996 | Takeda et al. . | |

*Primary Examiner*—Weilun Lo
*Attorney, Agent, or Firm*—Kilpatrick Stockton LLP

[57] ABSTRACT

An engine employing magnetically actuated valves. The engine includes a combustion chamber, a port, an electromagnet, a valve, a biasing spring, and a valve guide. The valve is operably positioned in relation to the combustion chamber to allow fuel into the chamber and is actuated by a magnetic field to move within the valve guide.

25 Claims, 12 Drawing Sheets

INTERNAL COMBUSTION ENGINE

This is a continuation-in-part application of pending application Ser. No. 08/824,471 filed Mar. 26, 1997, which is incorporated herein in full by reference.

FIELD OF THE INVENTION

The invention relates generally to a combustion engine, and pertains more specifically to a engine employing magnetically actuated valves.

BACKGROUND OF THE INVENTION

The operation of a standard internal combustion engine is well known. A mechanically operated valve opens to allow an air and fuel mixture to enter the combustion chamber of an engine's cylinder. A spark within the cylinder ignites the air and fuel mixture, which causes the engine's piston to move. The moving piston provides torque, or turning force, to a crankshaft. The turning force of the crankshaft provides mechanical power for use in the chosen application, such as causing an automobile's wheels to turn or causing the cutting blade of a lawnmower to turn. After the air and fuel mixture is ignited, another mechanically operated valve is opened, allowing the burned gases, or exhaust, to escape out of the cylinder.

As mentioned, the valves in the combustion engines of today are mechanically actuated. Typically, a push rod and rocker arm rod and rocker-arm experience wear during use and sometimes have to be replaced.

Moreover, the push rod and rocker-arm combination causes some parasitic power loss. For example, the movement of the push rod and rocker-arm combination is actuated by the camshaft and thusly interacts with valves. Spring loaded valves place a very large load upon the camshaft, which is turned by a crankshaft. This operation may take 30–40% of an engine's power. Moreover, friction between parts within that combination is created during the movement of the combination and thus energy is used in overcoming that friction instead of directly used in the movement of a valve.

In addition, the push rod and rocker-arm combination takes up space in the engine and has some weight. Thus, the weight of the combination adds to the weight which the engine must drive, thereby increasing the force required of the engine. Moreover, the push rod and rocker-arm combination requires lubrication.

Thus, the currently-used system, embodied by a push rod and rocker-arm combination, that is presently used to open and close engine valves has several disadvantages.

The objective of the present invention is to provide a means for opening and closing the valves of a combustion engine that reduces or eliminates the disadvantages of the present system. The objective of the present invention is to provide a means for opening and closing the valves of a cylinder of a combustion engine that (1) reduces parasitic power loss caused by the movement of the currently-used system; (2) reduces the weight of an engine, thus allowing for increased fuel efficiency or increased power of an engine; (3) is easier than the currently-used system to maintain; (4) is versatile in that it can be used in a variety of engine types and sizes; (5) increases design possibilities by lessening the space taken up by means to operate engine valves; (6) is relatively easy to construct; (7) can provide valves that are substantially removed from the combustion area of the engine during the combustion phase of the engine; (8) can provide ports that are not substantially blocked by valves during the injection/exhaust phase of operation; and (9) can provide an engine that causes fewer parts than conventional engines and that incurs less wear on the engine parts. The construction of the present invention requires fewer parts that today's engines and is consequently less expensive that the construction of today's engines. Moreover, the use of magnetically actuated valves as described above allows the reduction of hydrocarbon emissions because the present invention lessens the contamination of the inlet charge and allows a higher compression ratio. Other advantages of the present invention will be apparent to those of ordinary skill in the art of the present invention.

SUMMARY OF THE INVENTION

The invention is an engine employing magnetically actuated valves. One embodiment of the engine includes a combustion chamber, a spark plug positioned to create a spark within said combustion chamber, a piston positioned within said combustion chamber, a crankshaft, a connecting rod, said connecting rod connecting said piston with said crankshaft, a fuel intake valve, and an exhaust valve. The fuel intake valve is operably positioned in relation to said combustion chamber to allow fuel into said combustion chamber. The fuel intake valve is actuated by a magnetic field. The exhaust valve is operably positioned in relation to said combustion chamber to allow exhaust to exit said combustion chamber. The exhaust valve is actuated by a second magnetic field.

DETAILED DESCRIPTION

Figure 1:
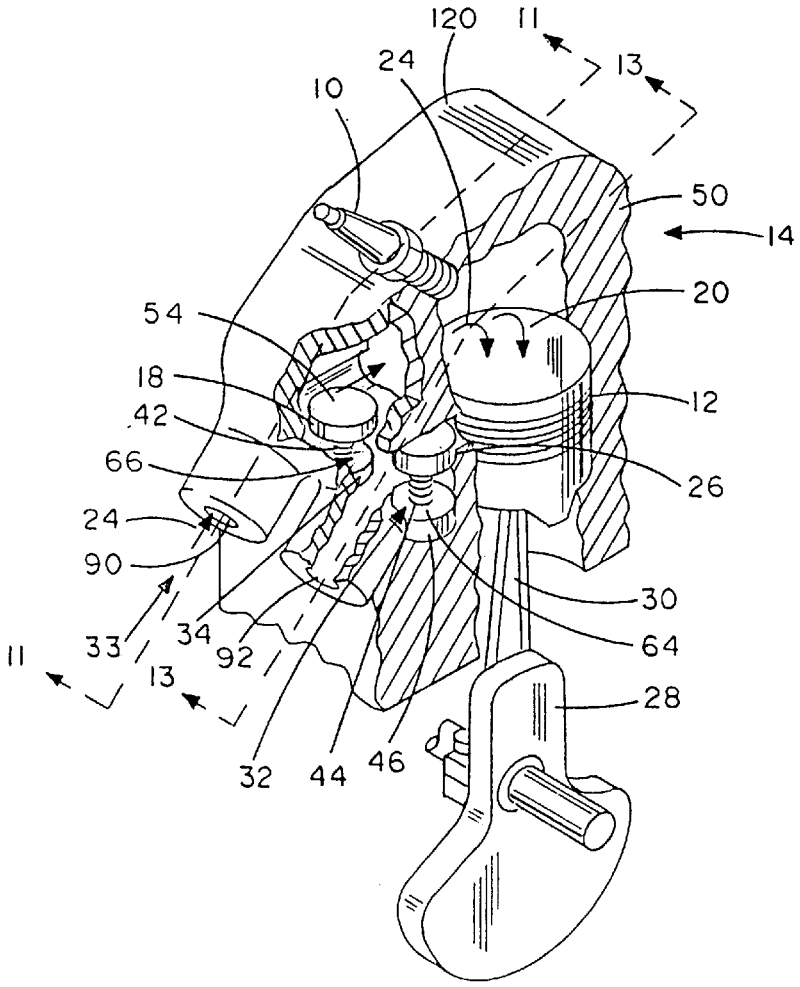
FIG. 1 shows a partial cut-away perspective view of a four-stroke engine of the present invention using magnetically actuated valves in its intake stroke.

FIG. 1 shows an embodiment of the present invention as a four-stroke, internal combustion engine using magnetically actuated valves. FIG. 1 shows a four-stroke, four-cycle engine 14. The engine 14 of FIG. 1 operates, with the exception of the valve operation, similarly to a standard four-stroke engine. The operation of a standard four-stroke engine is well known. Four events, or strokes, occur in order for the engine 14 of FIG. 1 to operate. Its operation takes place in two revolutions of the crankshaft 28. The four strokes that occur in the operation of the engine 14 are the intake stroke, shown in FIG. 1, the compression stroke, shown in FIG. 2, the power stroke, shown in FIG. 3, and the exhaust stroke, shown in FIG. 4.

Referring to FIG. 1, the intake stroke occurs when the piston 12 is traveling downward and creates a vacuum 50 within the cylinder 20. The cylinder is a combustion chamber. When the piston 12 begins to travel downward, a fuel intake valve magnet 34 emits an electromagnetic field (not shown). The magnets 34, 46 shown are stationary and are fixed by physical connection to the surrounding engine block. The magnets 34, 36 are capable of emitting an magnetic force sufficient to overcome the spring force of the springs. The electromagnetic field causes the fuel intake valve 18 to move toward the magnet 34 against the fuel-valve biasing spring 42 that the valve 18 is biased against, consequently compressing the biasing spring 42. The spring may be made of steel, such as high silicon steel, or other spring-biasing material. The valve and magnet are coupled to the spring in the embodiment shown by direct, physical attachment in the embodiment shown. The spring may rest between the valve and magnet (or between the valve and engine block in some embodiments) without physical attachment or be physically attached to the valve, magnet, or both. The magnet 34, spring 42, valve 18, in addition to a fuel intake valve cylinder 66, comprise what is referred to as a fuel intake magnetic valve assembly 33. The movement of the fuel intake valve 42 toward the magnet 34 leaves a gap 54 in the intake port 90. A combustible material 24, in the embodiment shown a fuel and air mixture, is drawn into the cylinder 20 through the gap 54 left in the port 90 by the movement of the fuel intake valve 18.

Figure 18:
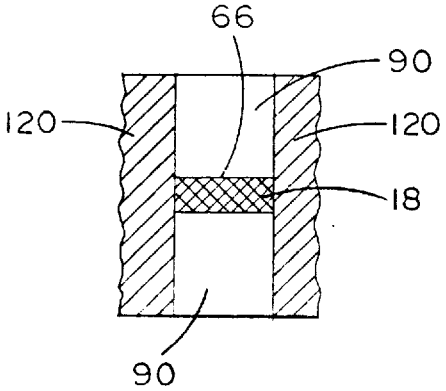
FIG. 18 shows a top cut-out view of an engine according to the present invention, showing a port, a valve, and the surrounding engine block.
Figure 19:
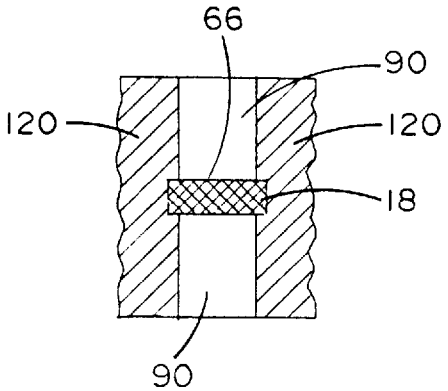
FIG. 19 shows a top cut-out view of an engine according to the present invention, showing a port, a valve, and the surrounding engine block.

The valve 18 shown is cylindrical, but it may be any convenient shape. For example, the valves shown in FIG. 18 and FIG. 19 are rectangular. The valve may be made of any material attracted to electromagnetic force, such as steel or cobalt. The fuel intake valve 18 reciprocates within the fuel intake valve cylinder 66. Likewise, the exhaust valve 26 reciprocates within the exhaust cylinder 64. The valve cylinder 66, 64 is one form of a valve guide. As shown, e.g., in FIG. 1 and FIG. 8, the fuel intake valve guide 66 is coupled to the fuel intake port 90, and the exhaust valve guide 64 is coupled to the exhaust port 92. The valve guides may take any shape, and generally conform to the shape of the valve which they guide.

Figure 8:
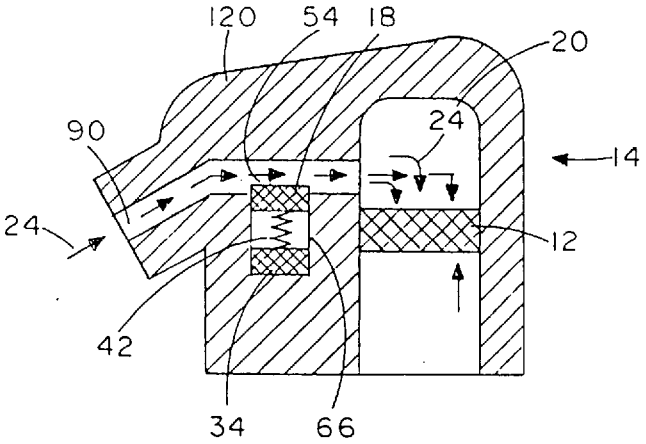
FIG. 8 shows a cut-out view of the engine shown in FIGS. 1–4 along the line 11—11 in the intake stroke, showing the intake valve assembly, intake port, and the gap in the intake port during the intake phase shown in FIG. 1.
Figure 9:
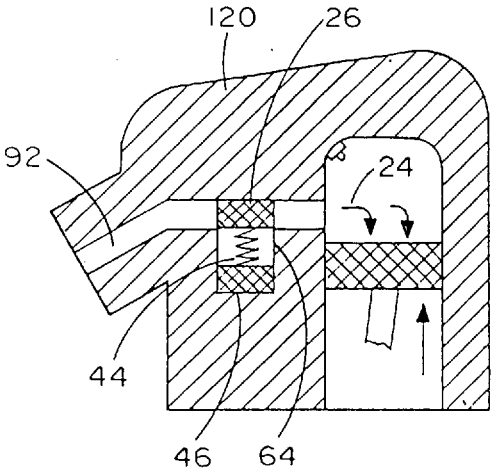
FIG. 9 shows a cut-out view of the engine shown in FIGS. 1–4 along the line 13—13 in the intake stroke, showing the exhaust valve assembly and exhaust port during the intake phase shown in FIG. 1.

The engine of FIG. 1 can be seen in a cut-out side view in FIG. 8 and FIG. 9. FIG. 8 shows the location of the intake valve 18 and the gap 54 in the intake port 90 and the intake valve guide 66 during this intake phase. FIG. 9 shows the location of the exhaust valve 26 in the exhaust port 92 and the exhaust valve guide 64 during this intake phase.

Note that when a valve 18, 26 blocks a port 90, 92, the valve 90, 92 is sufficiently close to the engine block 120, valve guide wall 66, 64, or shield (see below) that no, or insignificantly little, exhaust or intake material seeps into the valve guide 66, 64. Likewise, when a valve 18, 26 is lowered wholly or partially into the valve guide 66, 64 the valve is sufficiently close to the engine block 120, valve guide wall 66, 64, or shield that no, or insignificantly little, exhaust or intake material seeps into the valve guide 66, 64. Drainage structure, sealing structure, or other, similar devices could be used to combat seepage of intake or exhaust into the valve guide from the port.

Figure 2:
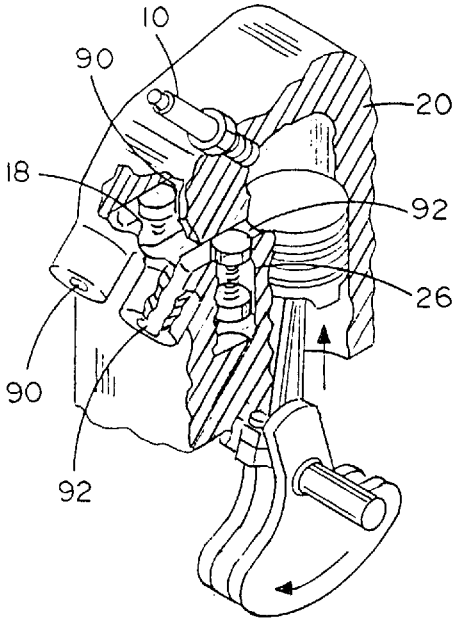
FIG. 2 shows a partial cut-away perspective view of a four-stroke engine of the present invention in its compression stroke.

Referring to FIG. 2, as the piston 12 begins to travel upward, the fuel intake valve magnet 34 ceases emitting an electromagnetic field. Consequently, the force of the fuel intake valve 18 no longer compresses the fuel-valve biasing spring 42, and the spring 42 forces the fuel intake valve 18 to move within the valve guide back into the intake port 90 to its normally-closed position. The fuel intake valve 18 thus moves upwards within the fuel intake valve guide such that it enters the fuel intake port 90, thereby blocking and closing the port 90. In this position, the valve 18 blocks any entry of air/fuel mixture 24 into the cylinder 20. Also, the closing of the valve 18 traps the fuel and air mixture 24 in the cylinder 20. The piston 12 travels upward and compresses the fuel and air mixture 24 in the cylinder 20. Thus, in this phase, both valves 18, 26 are in their normal position, blocking the ports 90, 92, and thereby closing the ports 90, 92.

Figure 10:
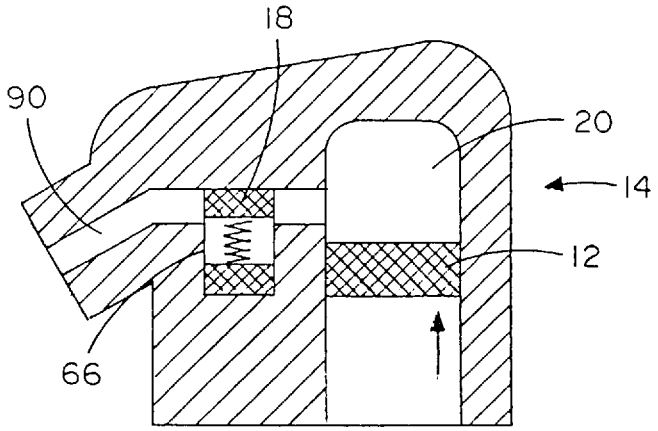
FIG. 10 shows a cut-out view of the engine shown in FIGS. 1–4 along the line 11—11 in the compression stroke, showing the intake valve assembly and intake port during the compression phase shown in FIG. 2.
Figure 11:
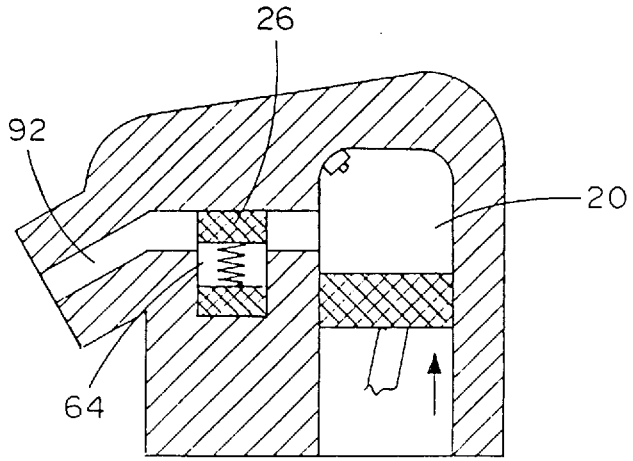
FIG. 11 shows a cut-out view of the engine shown in FIGS. 1–4 along the line 13—13 in the compression stroke, showing the exhaust valve assembly and exhaust port during the compression phase shown in FIG. 2.

The engine of FIG. 2 can be seen in a cut-out side view in FIG. 10 and FIG. 11. FIG. 10 shows the location of the intake valve 18 in the intake port 90 and the intake valve guide 66 during this compression phase. FIG. 11 shows the location of the exhaust valve 26 in the exhaust port 92 and the exhaust valve guide 64 during this compression phase.

Figure 3:
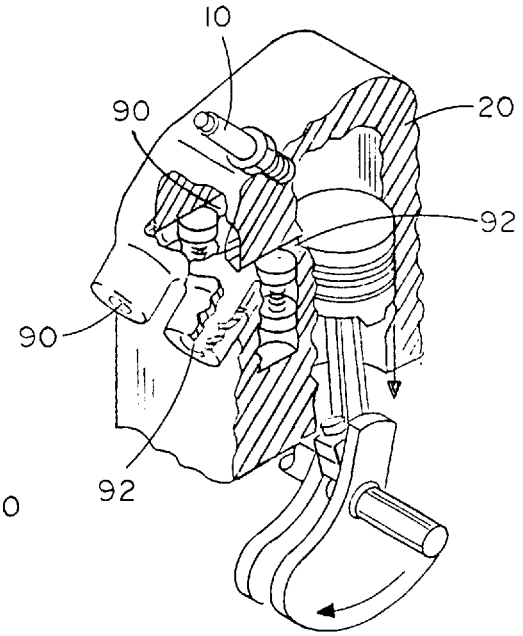
FIG. 3 shows a partial cut-away perspective view of a four-stroke engine of the present invention in its power stroke.

Referring to FIG. 3, when the piston 12 reaches the top of its stroke and starts back down the cylinder 20, the spark plug 10 provides a spark in the cylinder 20. This spark 52 (shown as wavey lines) ignites the air and fuel mixture 24, causing an explosion (not shown) in the cylinder 20. The explosion and rapid expansion of the gases (not shown) within the cylinder 20 causes the piston 12 to proceed downward in the cylinder 20.

Figure 12:
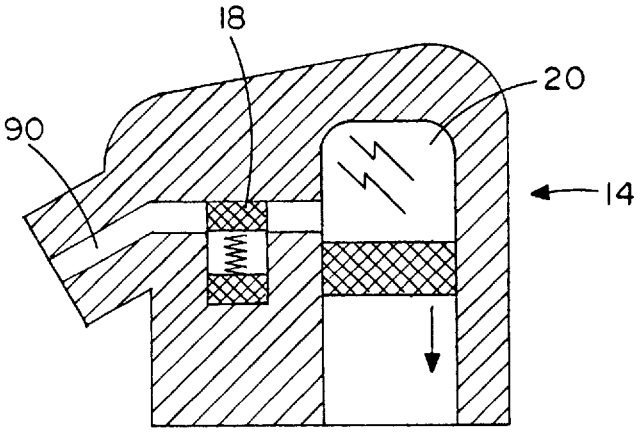
FIG. 12 shows a cut-out view of the engine shown in FIGS. 1–4 along the line 11—11 in the power stroke, showing the intake valve assembly and intake port during the power phase shown in FIG. 3.
Figure 13:
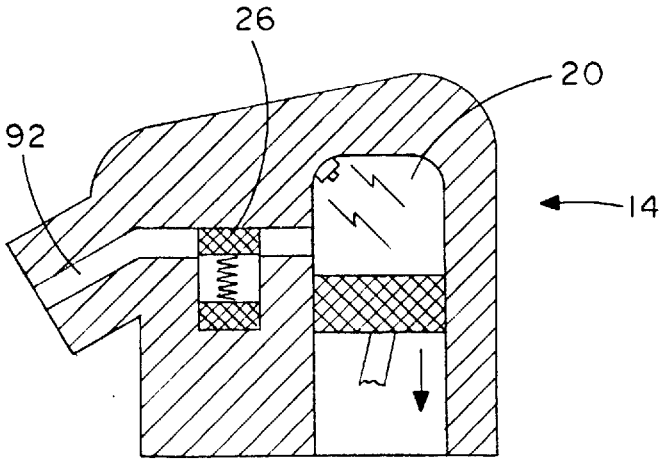
FIG. 13 shows a cut-out view of the engine shown in FIGS. 1–4 along the line 13—13 in the power stroke, showing the exhaust valve assembly and exhaust port during the power phase shown in FIG. 3.

The engine of FIG. 3 can be seen in a cut-out side view in FIG. 12 and FIG. 13. FIG. 12 shows the location of the intake valve 18 in the intake port 90 and the intake valve guide 66 during this power phase. FIG. 11 shows the location of the exhaust valve 26 in the exhaust port 92 and the exhaust valve guide 64 during this power phase.

Figure 4:
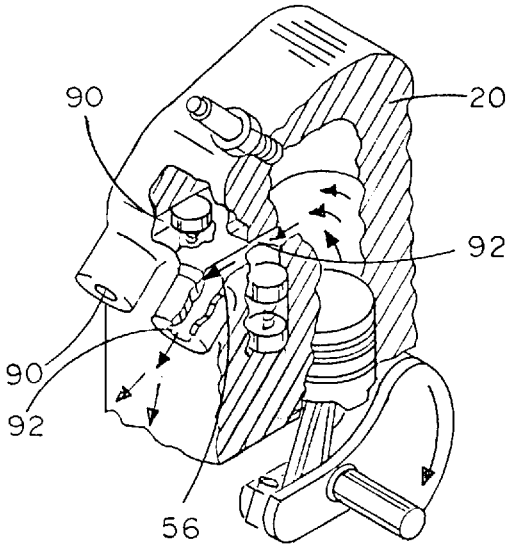
FIG. 4 shows a partial cut-away perspective view of a four-stroke engine of the present invention in its exhaust stroke.

Referring to FIG. 4, when the piston 12 reaches the end of its downward travel in the cylinder 20, an exhaust-valve magnet 46 emits an electromagnetic field (not shown). The electromagnetic field causes the exhaust valve 26 to move toward the magnet 46 against the exhaust-valve biasing spring 44 that the valve 26 is biased against, consequently compressing the biasing spring 44. The magnet 46, spring 44, valve 26, in addition to an exhaust valve cylinder 64, comprises what is referred to as an exhaust valve assembly 32. The movement of the exhaust valve 26 toward the magnet 46 leaves a gap 56 in the port 92. On the upcoming upward stroke of the piston 12, the piston 12 forces the burned gases or exhaust 60 out of the gap 56 in the port 92 caused by the opened valve 26.

Figure 14:
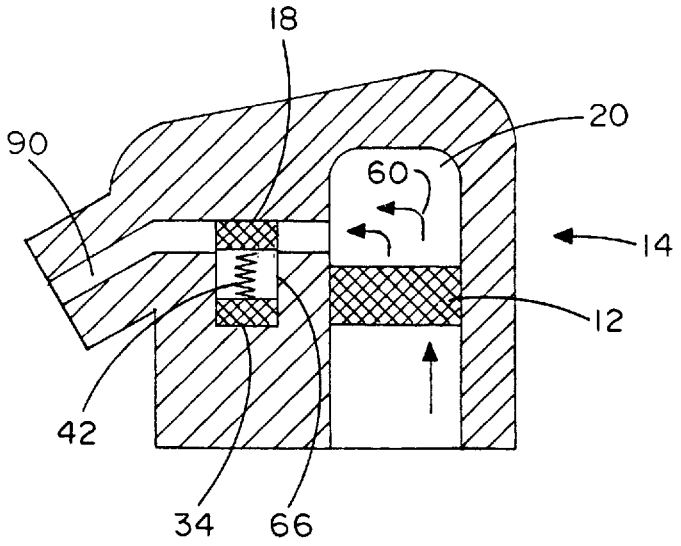
FIG. 14 shows a cut-out view of the engine shown in FIGS. 1–4 along the line 11—11 in the exhaust stroke, showing the intake valve assembly and intake port during the exhaust phase shown in FIG. 4.
Figure 15:
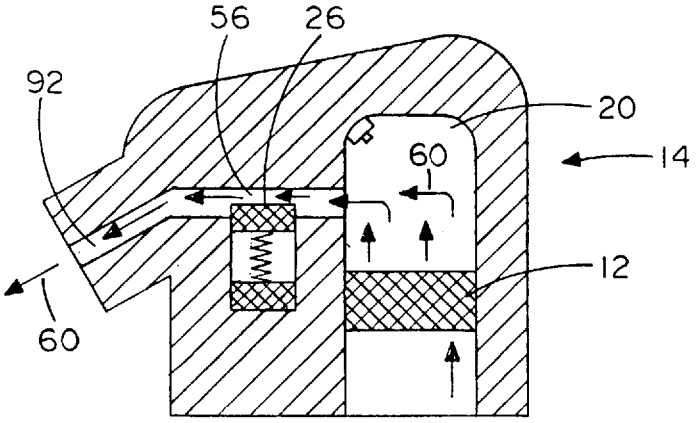
FIG. 15 shows a cut-out view of the engine shown in FIGS. 1–4 along the line 13—13 in the exhaust stroke, showing the exhaust valve assembly, exhaust port, and the gap in the exhaust port during the exhaust phase shown in FIG. 3.

The engine of FIG. 4 can be seen in a cut-out side view in FIG. 14 and FIG. 15. FIG. 14 shows the location of the intake valve 18 in the intake port 90 and the intake valve guide 66 during this exhaust phase. The intake port 90 is closed, blocked by the intake valve 18. FIG. 15 shows the location of the exhaust valve 26 and the gap in the exhaust port 92, and the exhaust valve guide 64 during this exhaust phase.

When the piston 12 reaches the top of cylinder 20, the exhaust magnet 46 ceases emitting an electromagnetic field. Consequently, the force of the exhaust valve 26 no longer compresses the exhaust biasing spring 44, and the spring 44 forces the exhaust valve 26 along the exhaust valve guide back into its normally-closed position, blocking the exhaust port 92. Immediately afterwards, the fuel intake valve 18 is opened as described above, and the piston 12 begins a downward stroke, and the four strokes described above begins again with the first stroke describe above.

Figure 23:
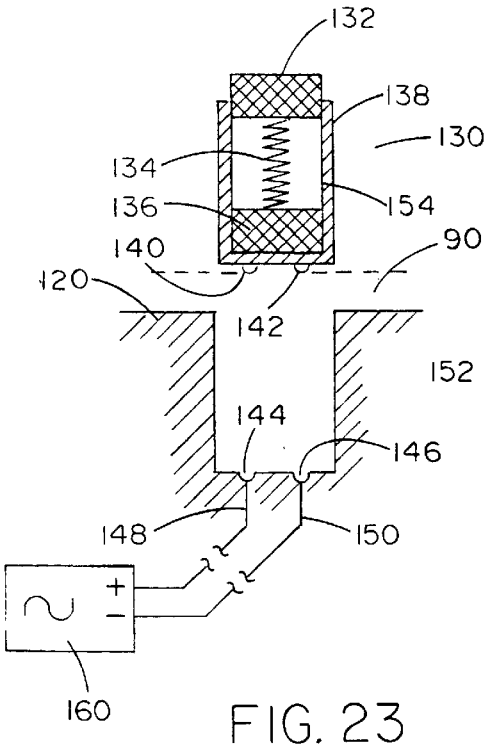
FIG. 23 shows a section view of part of an engine according to the present invention including a removable valve guide in the form of a magnetic shield, and a valve assembly, as well as electrical conductors and receptacles for supplying power to an electromagnet.

The intake electromagnet 34 and the exhaust electromagnet 46 can be energized by an ignition system (not shown) or other power source, to which the electromagnets of the engine are connected. For example, FIG. 23 shows an electromagnet connected to an AC power source 160. The ignition system can be controlled by, for example, a crank trigger (not shown) or CPU (not shown). The electromagnet 34, 46 exerts sufficient electromagnetic force to overcome the valve spring 42, 44 pressure to "open" the valve in the shown embodiment. The present invention could be configured to provide a valve that is normally open, and that closes upon actuation of an electromagnet.

Figure 16:
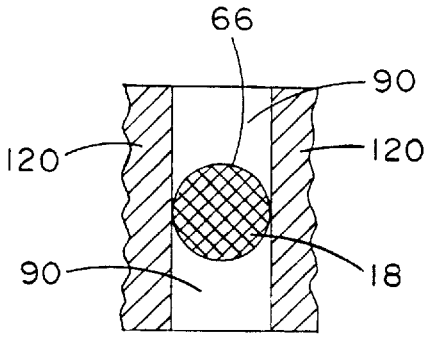
FIG. 16 shows a top cut-out view of an engine according to the present invention, showing a port, a valve, and the surrounding engine block.
Figure 17:
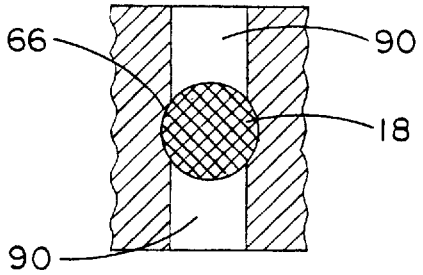
FIG. 17 shows a top cut-out view of an engine according to the present invention, showing a port, a valve, and the surrounding engine block.

As mentioned above, the valves 18, 36 may be of any selected shape. Referring to FIGS. 16–19, the valve guide 66 may be coupled to the port 90 in a number of configurations. The valve guide 66 may be cut to the dimensions of the port 90 as shown in FIGS. 16 and 18. Also, at the point of coupling, the valve guide 66 may be wider than the port 90 is through the rest of the port's length, as shown in FIGS. 17 and 19. Configurations such as that shown in FIGS. 17 and 19 allow the engine block to assist somewhat in resisting the forces upon the valve during the combustion phase of an engine's operation.

Note that in the embodiment shown, the force as a result of combustion is perpendicular to the springs. Thus, it is not necessary for the spring to be of such strength to withstand the direct force of the combustion.

Figure 5:
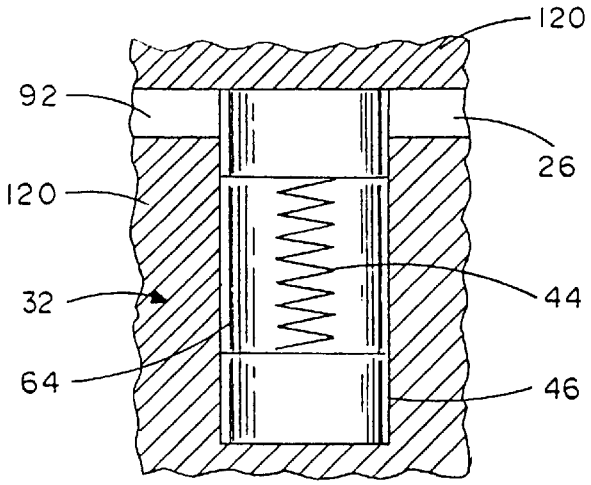
FIG. 5 shows a sectional view showing a full valve, spring, and magnet in a valve cylinder, the surrounding engine block in a cut-out view, and a port used in the present invention.

FIG. 5 shows a cut-out, close-up view of a magnetically actuated valve assembly used as the assembly for the fuel intake valve 18 or the exhaust valve 26 of the present invention as shown in FIGS. 1–4. The magnetically actuated valve assembly shown in FIG. 5 is the exhaust valve assembly 32 shown in FIGS. 1–4. The assembly 32 of FIGS. 1–5 comprises a magnet 46, a spring 44, an exhaust valve 26, and an exhaust valve cylinder 64. The fuel valve assembly 33 of FIGS. 1–4 similarly comprises a magnet 34, a spring 42, an fuel valve 18, and a fuel valve cylinder 66. The fuel valve cylinder 64, 66 shown comprises a cylindrical area cut into the engine block 120. The engine block may be made of steel or other material used to construct engine blocks.

Figure 6:
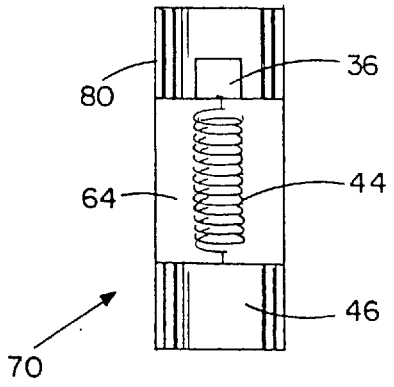
FIG. 6 shows a sectional view showing a full valve with a ferromagnetic insert, spring, and magnet in a valve cylinder, the surrounding engine block in a cut-out view, and a port used in the present invention used in the present invention.

Another magnetically actuated valve assembly 70 is shown in FIG. 6. FIG. 6 shows a cut-out, close-up side-view of a magnetically actuated valve assembly 70 with a ferromagnetic insert 36 as used in the present invention. A magnetically actuated valve assembly 70 of FIG. 6 can be used in place of the assemblies 32, 33 of FIGS. 1–5. An engine including the valve assembly 70 of FIG. 6 operates in the same manner as described above in describing FIGS. 1–4.

The assembly 70 shown in FIG. 6, referred to because convenient as an exhaust valve assembly, comprises a magnet 46, a spring 44, a non-magnetic exhaust valve 80 made of a high-wear non-conductive material, for example, ceramic, a magnetic insert 36 inserted into the exhaust valve 80, preferably inserted into the portion of the exhaust valve 80 nearest the magnet 46, and an exhaust valve cylinder 64. The insert may be made of cobalt or another material capable attracted to magnetic energy. Thus, instead of the entire valve being attracted by the magnet 46, the magnet attracts the magnetic insert 36, and the magnetic insert in turn forces the valve 80 against the spring 44 toward the magnet 46. Note that the valve portion 80 may be made of such material that insulates the port, intake/exhaust, and other structure from the electromagnetic field.

Figure 7:
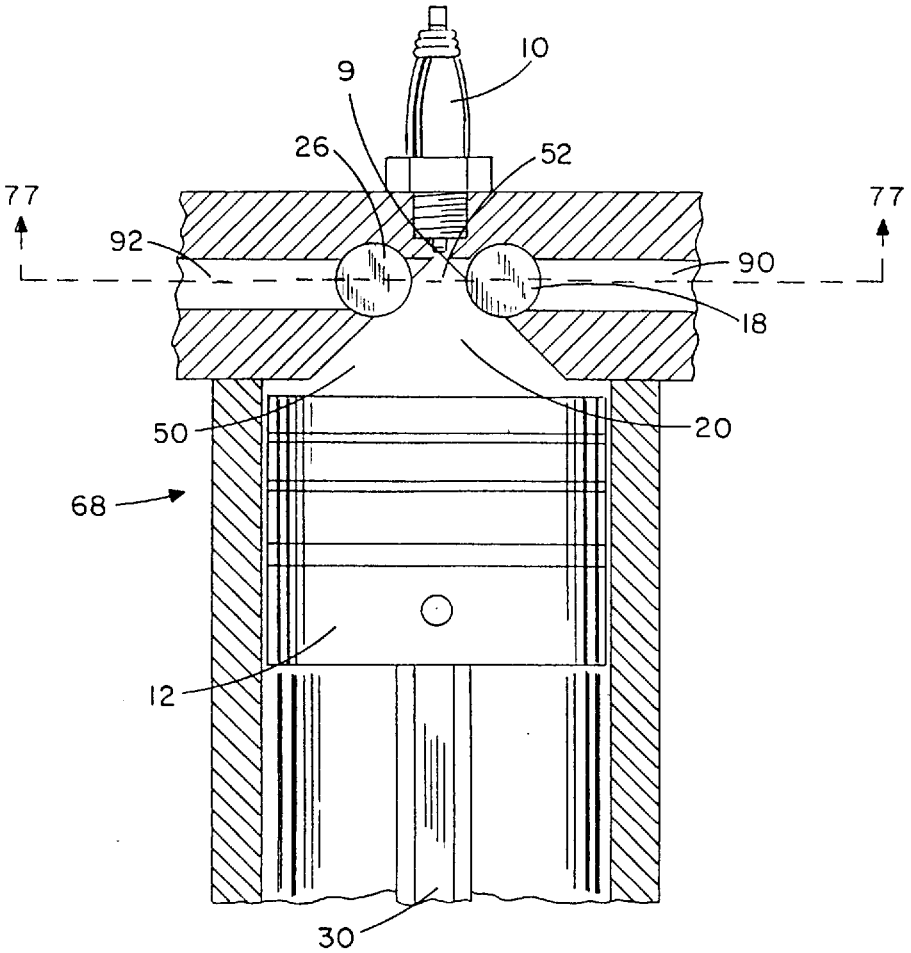
FIG. 7 shows a cut-out view of an engineer with a spark plug placed at the top center of a cylinder with a cone-shaped combustion chamber, and fuel intake valve and exhaust valves placed on the upper side of said cylinder, wherein a fuel intake port is connected to a fuel intake valve and an exhaust port is connected to the exhaust valve, and the two ports are aligned.
Figure 20:
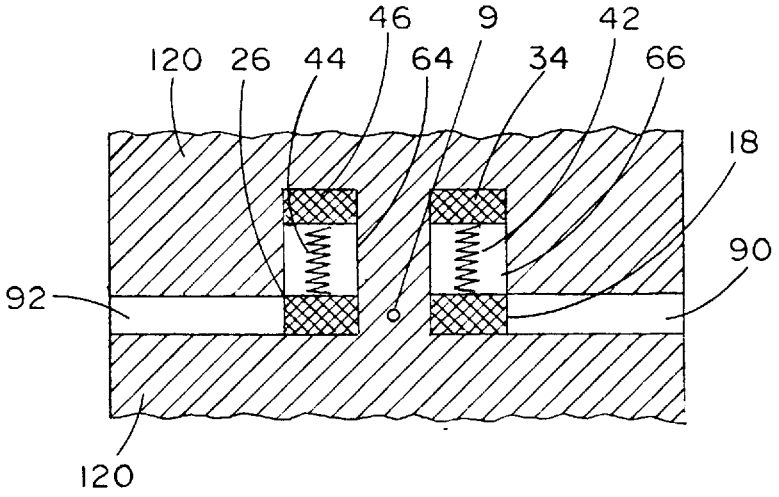
FIG. 20 shows a cut-out view of the engine shown in FIG. 7 along the line 77—77.

FIG. 7 shows the cylinder head portion 68 and surrounding structure of another embodiment of the present invention. The cylinder 20 has a spark plug 10 placed at the top center of the cylinder 20 with a cone-shaped combustion chamber 50. The fuel intake valve 18 and exhaust valve 26 (shown in side view) are placed on the upper side of the cylinder 20. The valves reciprocate within the valve cylinder perpendicular to the cylinder head 12. The fuel intake port 90 is connected to a fuel intake valve 18 (shown in side view). An exhaust port 92 is connected to the exhaust valve 26. The fuel intake port 90 and the exhaust port 92 are aligned. The valves 18, 26, operate like the valves of the embodiments described above. That is, the embodiment shown in FIG. 7 operates in a four-stroke engine just like the corresponding parts of the above embodiments. The cylinder hear portion 68 shown in FIG. 7 is substituted for those parts in operation. The valves 18, 26 shown in FIG. 7 operate as magnetically actuated valves just as the valves 18, 26 of embodiments described above. An engine using the cylinder head portion shown in FIG. 7 can be designed in a streamlined manner and compact manner, allowing for a greater degree of design freedom. FIG. 20 shows a cut-out view of the embodiment shown in FIG. 7 along the line 77—77. As described above, upon actuation of the exhaust valve electromagnet 46, the exhaust valve 26 moves towards the electromagnet 46 within the exhaust valve guide 64, compresses the spring 44, moves substantially outside of the exhaust port 92, thus unblocking the path between the port 92 and the cylinder 20. Likewise, as described above, upon actuation of the intake valve electromagnet 34, the intake valve 18 moves towards the electromagnet 34 within the intake valve guide 66, compresses the spring 42, moves substantially outside the intake port 90, thus unblocking the path between the port 90 and the cylinder 20. The tip of the spark plug 9 is also shown. Note that the movement of the valves are perpendicular to the movement of the cylinder head 12 in this embodiment. The invention contemplates movement of the valves at any angle relative to the cylinder head; any angle at which the valve guide is constructed relative to the cylinder head.

Figure 21:
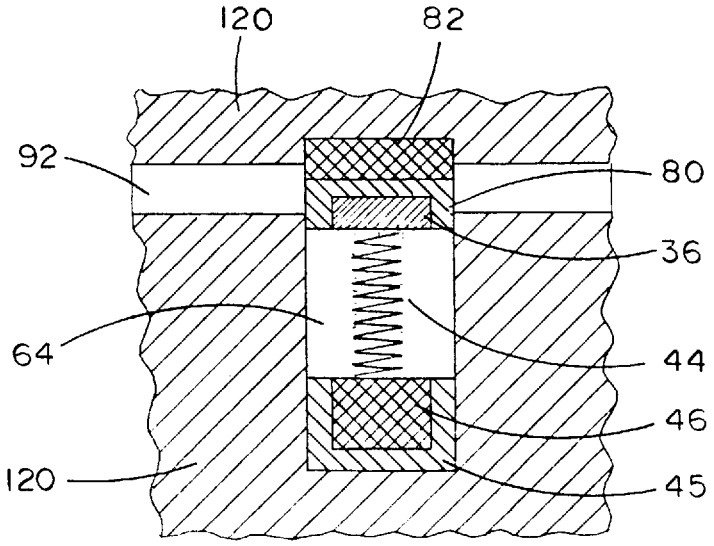
FIG. 21 shows a sectional view showing a bumper, valve (with insert), spring, and magnet in a valve cylinder, the surrounding engine block in a cut-out view, and a port used in the present invention, wherein the port is closed.
Figure 22:
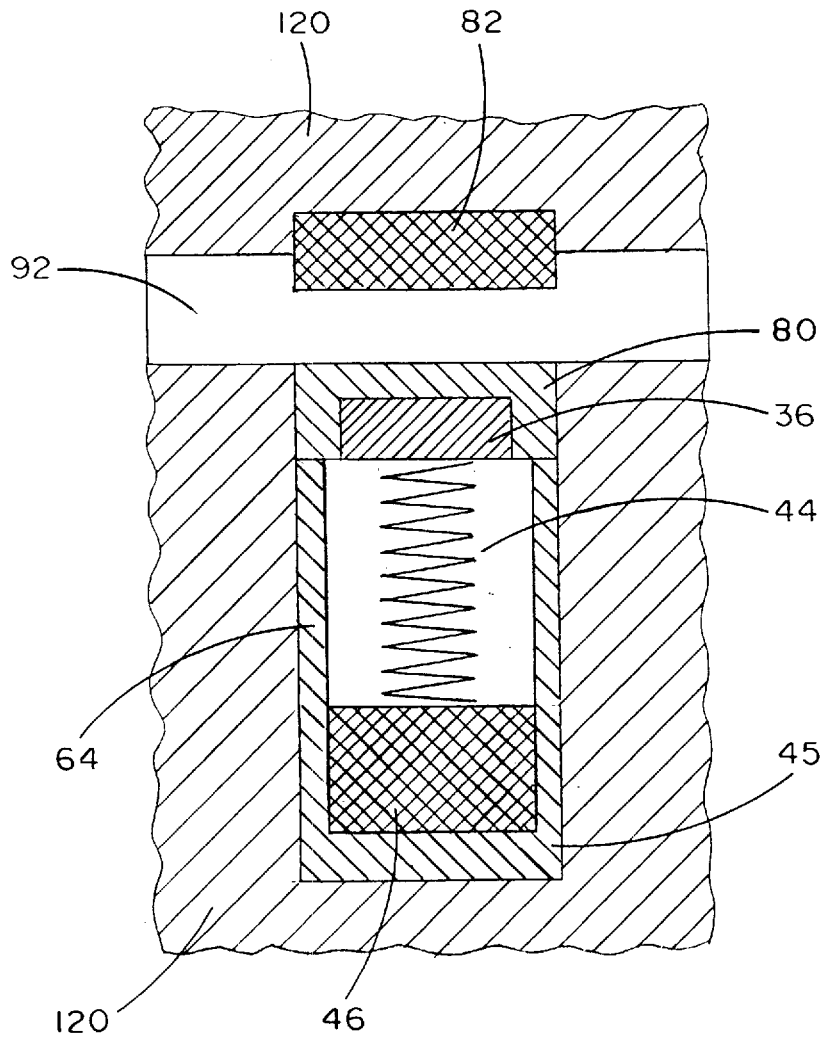
FIG. 22 shows a sectional view showing a bumper, valve (with insert), spring, and magnet in a valve cylinder, the surrounding engine block in a cut-out view, and a port used in the present invention, wherein the port is open.

FIGS. 21 and 22 show another embodiment of the present invention. FIG. 21 shows an exhaust valve assembly and surrounding structure. Like the valve portion shown in FIG. 6, the valve portion of the assembly includes a non-magnetic exhaust valve 80 with a magnetic insert 36. The non-magnetic element is not attracted to electromagnetic force from the magnet 46, but the magnetic insert 36 is attracted to said force. The electromagnet 46 is housed in a magnet insulator 45, which serves to insulate the surrounding engine block 120 from the magnetic field from the electromagnet 46. FIG. 21 also shows a bumper 82 of the present invention. The bumper 82 shown is stationary, and is coupled to the engine block 120 above the mouth of the valve guide, and partially blocks the port 92. Bumpers located in a different place and configuration, and bumpers that do not partially block the port 92, may also be used. The bumper 82 cushions the valve when the valve closes the port 92. The bumper 82 may be made of a variety of materials, including Teflon or steel. FIG. 21 shows the valve 80 resting against the bumper 82, thereby blocking the port 92, when the electromagnet is not actuated. When the electromagnet is actuated, the valve 80 and insert 36 move within the valve guide towards the magnet 46, thereby compressing the spring 44. In this embodiment, the valve 80 moves towards the magnet 46 until it is stopped by the upper edges of the insulator 46 as shown.

FIG. 23 shows one embodiment of a removable valve assembly 130, including a valve 132, a spring 134, an electromagnet 136, a valve guide comprised of a magnetic-field shield 138, and conductors 140, 142. In this embodiment, the shield 138 serves as a housing form the assembly 130. The removable assembly 130 is constructed to fit within a cut-out portion 152 of the engine block 120 coupled to a port 90. The conductors 140, 142 rest within two receptacles 144, 146 which serve to connect the conductors 140, 142 to wires 148, 150 embedded within the engine block 120. The wires 148, 150 are connected to a power source (not shown) controlled by a computer (not shown). The wires 148, 150, receptacles 144, 146, and conductors 140, 142 are used to provide power to the electromagnet 136.

Figure 24:
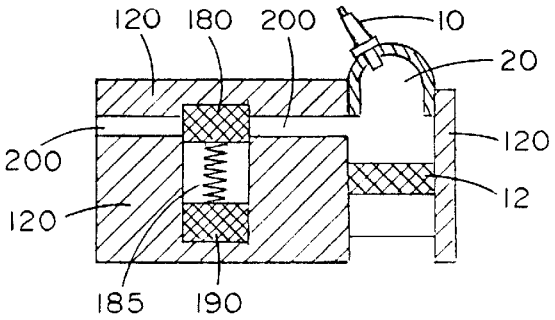
FIG. 24 shows a sectional view of an engine according to the present invention having a single port, valve, and electromagnet for exhaust and intake.

The embodiments shown in the figures discussed above have two ports, an exhaust port and an intake port. Engines of the present invention may have just one port, that serves as both an intake and an exhaust port, or that serves as just an intake port, or otherwise, or may have two, three, four, or more ports, as desired and needed for a particular application. FIG. 24 shows a cut-out view of part of an engine according to the present invention. Port 200 serves as both an intake and exhaust port. Valve 180 serves to block intake from entering the combustion chamber 20 during the appropriate times, serves to keep intake from escaping the chamber 20 during the appropriate times, and serves to block exhaust from exiting the combustion chamber 20 during the appropriate time which the valve 180 blocks the port 200. Likewise, the valve 180 moves towards the magnet 190 into the valve guide at the appropriate times to allow intake to enter the chamber and exhaust to exit the chamber at the appropriate times.

The embodiment shown in FIGS. 1–4 is in the embodiment of a four-stroke engine. The engine of the present invention is equally effective, when embodied in a two-stroke engine or other types of engines. The valves, or valve assembly, of the present invention replace the standard valves, or valve assembly, of those engines in the same manner as described above for a four-stroke engine. Those valves operate in a two-stroke engine and other engines in the same or similar manner as described above for a four-stroke engine.

Figure 26:
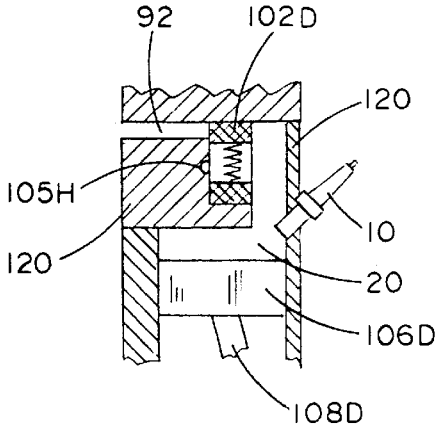
FIG. 26 shows a sectional view of the engine shown in FIG. 25.
Figure 25:
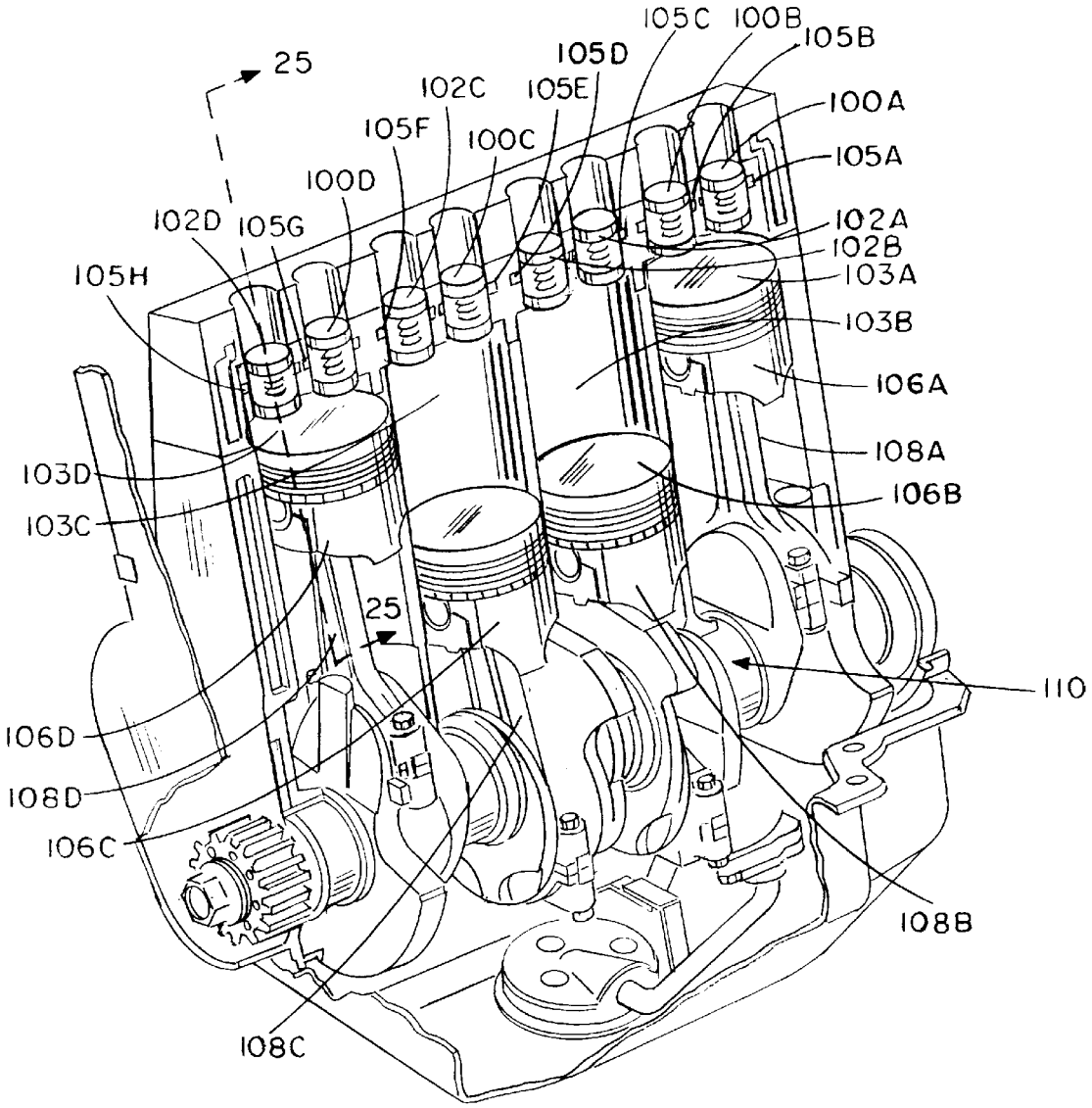
FIG. 25 shows an engine according to the present invention having four cylinders.

Of course, an engine may comprise more than one set, or some combination thereof, of elements of the present invention. For example, in a 4-cylinder engine, popular for use in automobiles, an engine might employ 4 cylinders, 4 spark plugs, 4 pistons, 4 crankshafts, 4 connecting rods, 4 fuel intake valves, and 4 exhaust valves. FIG. 25 shows a cut-out view of a portion of a 4-cylinder engine of the present invention with 4 cylinders, 4 spark plugs, 4 pistons, 4 crankshafts, 4 connecting rods, 4 fuel intake valves, and 4 exhaust valves. In FIG. 8, four fuel intake valves 100*a*–*d* and four exhaust valves 102*a*–*d* are positioned above four cylinders 103*a*–*d* containing four pistons 106*a*–*d*. The pistons 106*a*–*d* are connected to four connecting rods 108*a*–*d*, which are in turn connected to a crankshaft 110. As described above, in the embodiment shown in FIG. 25, a electromagnetic means is used to operate the valves, instead of the rocker arm means used in prior art engines. The operation of a four-cylinder engine is well known. In the present invention, each of valves 100*a*–*d*, 102*a*–*d* are operated in the same manner as the valves described above in a single-cylinder environment. In the embodiment shown in FIG. 8, each valve 100*a*–*d*, 102*a*–*d* is associated with an electromagnet 105*a*–*h*. Each partially encircles the valve guide with which it is associated. An electromagnet, e.g.,

105*c,* actuates the movement of a valve, e.g., fuel intake valve 100*b,* in the same manner as described above, allowing fuel to enter the cylinder or exhaust to exit the cylinder. A cut-out side view along the line 25—25 is shown in FIG. 26, showing further detail of this embodiment. As can be seen, the exhaust port 92 is coupled to a combustion chamber 20. The valve 102D serves to block the port, thereby keeping the port closed, during the appropriate phases of engine operation (described above). When exhaust is to be removed from the chamber 20, the electromagnets 105H and 105G actuate, emitting an electromagnetic field and forcing the valve against the spring, towards the engine block 120 below, thereby forcing the valve 102D into the valve guide and at least partially outside of the port 92, allowing exhaust to exit the chamber 20.

FIG. 26 shows a sectional side view of the engine shown in FIG. 25. The coupling between the port 92 and the cylinder 20 can be seen more clearly. Each of the valves 100*a–d,* 102*a–d* is associated with like structure.

Methods such as boring, die-casting, molding, and other techniques used in engine construction can be used to construct engines according to the present invention. Such engines may be used in a wide variety of applications, including automobiles and other vehicles, lawn mowers, heavy equipment, generators, tools, and other applications that may employ engines.

The foregoing is provided for purposes of explanation and disclosure of a preferred embodiment of the present invention. Modifications of and adaptations to the described embodiment will be apparent to those of ordinary skill in the art of the present invention and may be made without departing from the scope or spirit of the invention and the following claims.

I claim:

1. An engine employing magnetically actuated valves, said engine comprising:

a combustion chamber;

a port coupled to the combustion chamber;

a valve guide adjacent to the port and coupled to the port;

a valve adapted to move within the valve guide and within the port;

an electromagnet coupled to the valve guide; and a spring within the valve guide biasing the valve, wherein the valve is capable of movement within the valve guide such that the valve resides substantially outside of the port and substantially outside of the combustion chamber.

2. The engine of claim 1 wherein the valve is actuated by the electromagnet upon energization of the electromagnet to move within the valve guide such that the valve resides substantially outside of the port and substantially outside the combustion chamber.

3. The engine of claim 2 wherein the spring within the valve guide biases the valve within the port such that the port is thereby closed; and wherein the valve is actuated by the electromagnet upon energization of the electromagnet to move within the valve guide such that the port is thereby open.

4. The engine of claim 1 wherein the valve is adapted to reciprocate within said valve guide, wherein before actuation by said magnetic field said valve resides substantially inside of said port such that said port is thereby closed, and wherein after actuation by said magnetic field said valve resides substantially outside of said port such that said intake port is thereby substantially open.

5. The engine of claim 1 wherein said valve is made from a non-ferromagnetic material and said valve includes a ferromagnetic insert.

6. The engine of claim 1 further comprising a second port coupled to the combustion chamber;

a second valve guide adjacent to the second port and coupled to the second port;

a second valve adapted to move within the second valve guide and within the second port;

a second electromagnet coupled to the second valve guide;

a second spring within the second valve guide biasing the second valve, wherein said first port is adapted to receive combustible material and to provide the combustible material to the combustion chamber, and wherein said second port is adapted to receive exhaust material from the combustion chamber and to assist in expelling the exhaust material from the combustion chamber.

7. The engine of claim 1 wherein wherein the valve is capable of movement within the valve guide such that the valve resides fully outside of the combustion chamber.

8. The engine of claim 1 further comprising a bumper upon which the valve is biased by the spring.

9. The engine of claim 1 further comprising a magnetic shield adjacent to the electromagnet.

10. The engine of claim 1 wherein the valve, electromagnet, and spring reside within a housing.

11. The engine of claim 10 wherein the housing is removable.

12. The engine of claim 11 wherein the housing includes a magnetic shield.

13. The engine of claim 12 wherein a conductor is coupled to the electromagnet.

14. The engine of claim 2 wherein the electromagnet is within the valve guide and is coupled to the valve by the spring; and wherein the valve is actuated by the electromagnet upon energization of the electromagnet to move within the valve guide towards the electromagnet such that the coupling between the port and the chamber is substantially unobstructed.

15. The engine of claim 14 wherein the valve guide is substantially perpendicular to the port;

the valve guide is positioned below the port; and the electromagnet is positioned below the port.

16. An engine employing magnetically actuated valves, said engine comprising:

a combustion chamber;

a fuel intake port coupled to the combustion chamber;

a fuel intake valve guide adjacent to the fuel intake port;

a fuel intake valve operably positioned in relation to the combustion chamber to allow combustible material into the combustion chamber, the fuel intake valve actuated by a first magnetic field within the fuel intake valve guide; and an exhaust valve operably positioned in relation to the combustion chamber to allow exhaust to exit the combustion chamber, the exhaust valve actuated by a second magnetic field, and wherein the fuel intake valve is adapted to reciprocate within the fuel intake valve guide, and wherein before actuation by the first magnetic field the fuel intake valve resides substantially inside of the fuel intake port such that the intake port is thereby closed; and wherein after actuation by the first magnetic field the fuel intake valve resides substantially outside of the fuel intake port and fully outside of the combustion chamber such that the intake port is thereby substantially open.

17. The engine of claim 16, said engine further comprising a spark plug positioned to create a spark within the chamber; and a piston positioned within the chamber, wherein the first magnetic field is generated by a magnet disposed within the fuel intake valve guide, and wherein after actuation by the first magnetic field, said coupling between the fuel intake port and said combustion chamber is substantially unobstructed by the fuel intake valve.

18. The engine of claim 17 wherein the fuel intake port and the exhaust port are aligned, and the fuel intake port is substantially perpendicular to the fuel intake guide such that the fuel intake valve reciprocates in a horizontal plane.

19. A process of providing combustible material to a combustion chamber in an engine comprising the combustion chamber, a port coupled to the combustion chamber, a valve guide adjacent to the port and coupled to the port, a valve adapted to move within the valve guide and within the port, an electromagnet coupled to said valve guide, and a spring within the valve guide normally biasing the valve such that the valve blocks the port, said process comprising the steps of:

energizing the electromagnet such that the valve is attracted to the electromagnet and moves within the valve guide such that the valve resides substantially outside of the port and fully outside of the combustion chamber and no longer blocks the port, wherein before the step of energizing the electromagnet, the valve resides substantially inside of the port such that the intake port is thereby closed;

injecting combustible material into the port such that the combustible material travels through the port into the combustion chamber;

de-energizing the electromagnet such the valve moves within the valve guide such that the valve blocks the port.

20. A valve system for use in an engine having a combustion chamber and a port coupled to the combustion chamber, the valve system comprising:

a valve guide adapted to couple to the port;

a valve adapted to move within the valve guide and within the port;

an electromagnet coupled to the valve guide; and a spring within the valve guide biasing the valve, wherein the valve is capable of movement within the valve guide such that the valve resides substantially outside of the port and substantially outside of the combustion chamber.

21. The valve system of claim 20 wherein the valve is a fuel intake valve.

22. The valve system of claim 20 wherein said valve is made from a non-ferromagnetic material and said valve includes a ferromagnetic insert.

23. The valve system of claim 20 further comprising a magnetic shield adjacent to the electromagnet.

24. The valve system of claim 20 wherein the valve, electromagnet, and spring reside within a housing.

25. The valve system of claim 24 wherein the housing includes a magnetic shield.

* * * * *